United States Patent [19]

Winkelmann

[11] Patent Number: 4,512,658

[45] Date of Patent: Apr. 23, 1985

[54] ELECTROPHOTOGRAPHIC COPIER

[75] Inventor: Detlef Winkelmann, Wiesbaden, Fed. Rep. of Germany

[73] Assignee: Hoechst Aktiengesellschaft, Frankfurt am Main, Fed. Rep. of Germany

[21] Appl. No.: 485,504

[22] Filed: Apr. 15, 1983

[30] Foreign Application Priority Data

Apr. 21, 1982 [DE] Fed. Rep. of Germany ..... 3214653

[51] Int. Cl.[3] ..... G03G 15/00; G03G 27/00

[52] U.S. Cl. ..... 355/14 SH; 355/3 SH; 355/75

[58] Field of Search ..... 355/3 SH, 14 SH, 75, 355/76, 1, 16; 364/518; 271/51, 3, 272, 277; 281/8; 282/11.5 A

[56] References Cited

U.S. PATENT DOCUMENTS

| | | | |
|---|---|---|---|
| 3,614,090 | 10/1971 | Del Vecchio et al. | 271/51 |
| 3,659,935 | 5/1972 | Moraw | 355/1 |
| 4,057,348 | 11/1977 | Ritzerfeld | 355/75 |
| 4,068,948 | 1/1978 | Ritzerfeld | 355/75 |
| 4,158,886 | 6/1979 | Gray, Jr. et al. | 364/518 |
| 4,235,431 | 11/1980 | Abrams et al. | 355/3 SH X |
| 4,286,869 | 9/1981 | Kogane et al. | 355/75 |
| 4,320,963 | 3/1982 | Satomi | 271/3 X |

FOREIGN PATENT DOCUMENTS

| | | |
|---|---|---|
| 1946037 | 11/1969 | Fed. Rep. of Germany . |
| 2026063 | 12/1970 | Fed. Rep. of Germany . |
| 2828629 | 3/1979 | Fed. Rep. of Germany . |
| 2277370 | 7/1975 | France . |

OTHER PUBLICATIONS

European Search Report, EP 83103519.

*Primary Examiner*—A. C. Prescott

*Attorney, Agent, or Firm*—Schwartz, Jeffery, Schwaab, Mack, Blumenthal & Koch

[57] ABSTRACT

The present invention relates to an electrophotographic copier for the repetitive copying of originals. The copier comprises a transport apparatus having two film webs for transporting the original through an exposing station with the original being inserted between these film webs. The film webs of the transport apparatus are securely bonded together along a strip and form in the entry zone in advance of the exposing station a single-sided, Y-shaped pocket for the positioning of the leading edge of the original against the joint seam of the two film webs.

17 Claims, 7 Drawing Figures

ELECTROPHOTOGRAPHIC COPIER

BACKGROUND OF THE INVENTION

1. Field of the Invention

The present invention relates to an electrophotographic copier for copying originals onto an image receiving material by means of a photoconductor surface, and particularly to such a copier which uses films for transporting the originals through an exposing station wherein the individual original is inserted between these films.

2. Discussion of Related Art

There is a fundamental problem in carrying out the reproduction of technical drawings, particularly those used in design practice and in civil engineering and building activities, in highly automated copying machines, in that it is difficult to repetitively copy different drawing formats with nearly identical efficiencies. In the case of electrophotographic copiers, solutions such as using moving tables or moving mirrors for DIN A3 and A4 formats are adapted from the technology of office copiers. However, these solutions are transferable to electrophotographic copying equipment for processing the larger formats only at great expense.

German Auslegeschrift No. 2,026,063 discloses a sheet conveying apparatus for the purpose of moving originals which are to be copied, in particular originals of technical drawings, through the illumination and projection zone of a reproduction machine. This sheet conveying apparatus enables different length documents to be copied to be moved rapidly and repeatedly past the point at which they are processed. For this purpose, a conveying drum which can rotate in the conveying direction is located at the processing point. This drum has gripping devices which attach to the leading edge of the sheet. After having been attached to the sheet, the conveying drum is rotated through a predetermined angle and stopped, and an endless conveyor interacts with the conveying drum. This conveyor frictionally engages the sheet on the conveying drum and, once the conveying drum has stopped, displaces the sheet relative to the drum thus moving the rear portion of the sheet past the point at which it is to be processed. In a repetitive operation, the smallest format of a document moves in a circular motion without being guided, while larger formats are stopped and held in a loop, until the leading edge again sets them into motion. For this purpose, the original is securely held in a slot by means of a clamp. Using this system, it is impossible to expose the original with transmitted light, and it is consequently impossible to produce contact copies from the original. Furthermore, comparatively high design related expense is involved in providing the conveying drum with gripping devices.

A copying apparatus with a reflex-type exposing device is described in German Offenlegungsschrift No. 1,946,037, and likewise in U.S. Pat. No. 3,659,935, which apparatus arrangements are made to guide the image receiving material and the original in opposite directions, a short distance apart, at the end faces of a web-shaped glass fiber optical system. The original is guided along the exposing station between an optically transparent film and an endless belt.

The optically transparent film, the so-called spacing film, slides together with the original on the original side along one of the end faces of the glass fiber optical system. The film is then reversed at a roller and thereafter slides along the other end face of the glass fiber optical system, on the image receiving material side, together with the image receiving material. The transport of the original and of the image receiving material is thus effected only by a single film, which is wound and unwound onto and, as the case may be, from appropriate rollers. In this arrangement, it suffices to drive only one of the rollers. Although this copying apparatus is designed only for operation with reflex-type illumination, it can, however, also be employed for exposure with transmitted light. This copying apparatus has the disadvantage that the original is not held at a defined position, such as at its leading edge. Therefore, it is difficult to synchronize the original and the image receiving material when operating the copying apparatus in the repetitive mode.

SUMMARY OF THE INVENTION

One object of the present invention is to provide an electrophotographic copier which is capable of repetitively reproducing originals of different sizes, particularly of large formats.

Another object of the present invention is to provide an electrophotographic copier which can reproduce large format originals and which includes a transport mechanism for holding the originals in a secure manner to ensure accurate repetitive reproductions.

A further object of the present invention is to provide an electrophotographic copier for large format originals which includes a transport mechanism which can be designed to accommodate either transmitted light copying or reflected light copying.

In accordance with the above and other objects, the present invention is an electrophotographic copier, comprising an exposing station having an entry zone with an entry plane on which an original to be copied is introduced into said entry zone, and a transport mechanism for repetitively transporting an original through the exposing station from said entry zone. The transport mechanism comprises two film webs bonded at a joint seam to form a Y-shaped pocket for receiving the leading edge of an original to be copied. The Y-shaped pocket is positioned in the entry zone to receive an original to be copied from said entry plane. Means are provided for closing the Y-shaped pocket on an original and drawing the film webs past the exposing station from the entry zone.

In one embodiment, the copier includes two film supply rollers. A portion of each of the film webs is wound onto a different one of the film supply rollers. One of the film supply rollers is positioned above the entry plane and the other film supply roller is arranged below the entry plane. Also, the means for closing the Y-shaped pocket includes means for directing film webbing from the film supply rollers into a V shape in the entry zone.

In another embodiment of the electrophotographic copier, one of the film webs is an endless belt and the other of said film webs is a tongue fastened to the endless belt. The tongue has a length at least equal to the length of the smallest original to be copied.

BRIEF DESCRIPTION OF THE DRAWINGS

The above and other objects of the present invention will be more readily apparent in connection with the detailed description set forth below, reference being had to the accompanying drawings in which like reference numerals represent like parts throughout and in which.

DETAILED DESCRIPTION OF THE PREFERRED EMBODIMENTS

Before describing the illustrative embodiments of an electrophotographic copier according to the present invention in detail, the configuration of film webs to be used for transporting an original will first be discussed with reference to FIGS. 5*a* and 5*b*. These film webs are used in the transport devices for the electrophotographic copiers according to FIGS. 1 to 3 and to FIGS. 4*a* and 4*b*, respectively.

Figure 5A:
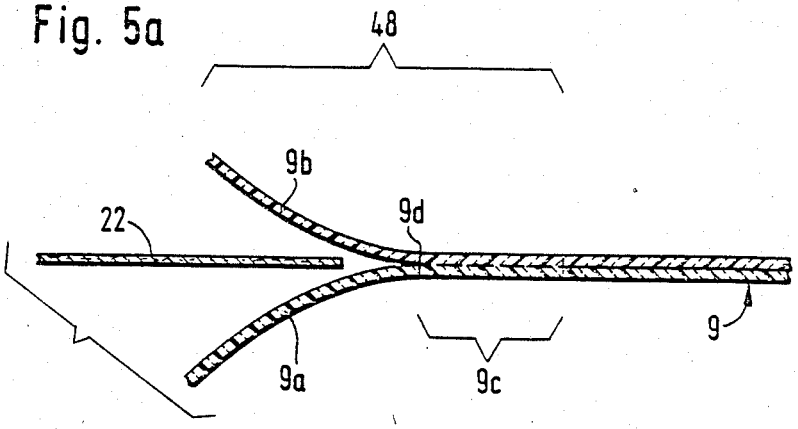
FIGS. 5*a* and 5*b* show sectional views of the film webs of the transport devices according to the illustrative embodiments of FIGS. 1 to 3 and FIGS. 4*a* and 4*b*, respectively.

FIG. 5*a* shows a lower film web 9*a* and an upper film web 9*b*, which are securely bonded together along a strip 9*c* by, for example, welding. The leading edge of an original 22 is guided against a joint seam 9*d* at the beginning of the strip 9*c*. This joint seam 9*d* runs transversely across the direction in which the joined film webs 9 move. The two film webs 9*a* and 9*b* form a single-sided, Y-shaped opened pocket 48 and the original 22 is introduced into the acute angled opening of this pocket. Of the two film webs, at least that web through which the image on the original to be copied can be seen is composed of a clear, transparent film material. Polyester films, polycarbonate films, or acetate films are particularly suitable for this purpose. Of these film materials, polyester films which have been stretched bidirectionally possess a high mechanical strength thus enabling very thin film material to be used. For example, it is possible to bond two polyester films 50 μm thick, forming the guide for the original, to a polyester film having a thickness of 100 μm. Since polyester films are difficult to bond by means of adhesives, this operation is expediently performed by means of ultrasonic welding. Although it is preferable that the other film web be perfectly transparent in the same way, this is nevertheless not at all mandatory. Even if exposures are to be performed by transmitted light, it is sufficient for this film web to be opaquely translucent. If the images are to be formed by incident light, that is to say if reflex exposures are to be made, it can even be more advantageous if this film web is designed to be reflective, and white in color. Pigment-filled polyvinyl chloride films (PVC films) which have been subjected to a surface roughening treatment can be combined with a transparent PVC film web to form a guide for the original. For this purpose, it is possible to fuse a white PVC film 200 μm thick to a transparent PVC film 100 μm thick by applying heat over a zone of a few centimeters, thus producing the desired Y-shaped bond between the films. It is also possible to use a textile web instead of the one film web which does not need to be transparent. However, in this case it is advisable to utilize a mechanical connection in the form of a 2-element or 3-element hinge to which the film webs or film belts are fastened since welding or adhesive bonding a transparent film to a textile web does not produce a bond having the desired strength.

It is possible to employ film webs with a width somewhat in excess of 1 m without difficulty. This enables the largest document formats, having widths of approximately 90 cm, to be transported with ease.

With respect to the length of the film webs, it is also possible to cover all the necessary format lengths of originals without difficulty. It is usual to design the pocket 48 with a length such that it is possible to guide even the longest original formats and such that adequate run-in and run-out is available, subject to the dimensions of the equipment. In this regard, in practice, it is possible for the originals to have total lengths of approximately 2 to 3 meters.

The embodiment of the film webs 9*a* and 9*b*, as well as of the pocket 48, shown in FIG. 5*a* is employed exclusively in electrophotographic copiers which operate by contact exposing the original. In this type of copier, the original bears against the photoconductor surface separated only by one of the film webs and the imaging of the original is effected by transmitted light.

Figure 5B:
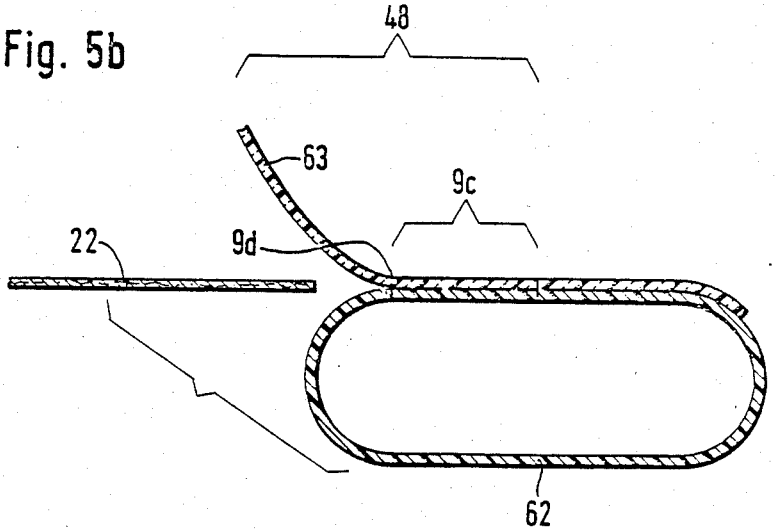

FIG. 5*b* shows the design of film webs for imaging the original 22 in incident light. For this purpose, an endless film web 62 is provided and a further film web 63 is fastened to web 62 across the width of the strip 9*c*. The original 22 is introduced into the acute-angled opening formed by the endless film web 62 and the film web 63 until it is positioned against the joint seam 9*d*. In this design, the film web 63 is transparent, and because its function of protecting the original 22 is only of minor significance, it does not necessarily need to cover the complete length of the original 22. It is completely adequate if the film web 63 has a length which ensures that the largest original 22 which is to be copied is held in a secure manner.

A first embodiment of an electrophotographic copier according to the present invention will now be described with reference to FIG. 1.

A drum 1 with a photoconductor surface 30 is mounted in a housing of the electrophotographic copier in a manner permitting counterclockwise rotation, the housing being omitted from the Figures. The following devices are arranged along the peripheral surface of the drum 1: a charging device 4, which may be a charging corona, an exposing station 5, a developing station 25, a transfer station 26, a cleaning station 31, and a device for discharging the photoconductor surface 30, which may be a discharging lamp 4*a*.

The original 22 may be fed in manually, semi-automatically, or fully automatically over an original entry plane 23 of the electrophotographic copier to the transport device. This transport device comprises a lower film supply roller 6 and an upper film supply roller 7, which are driven by a common drive system 70 and, in addition, a take-up roller 8, auxiliary rollers 28 and 29, as well as the film webs 9*a* and 9*b*, the design of which has already been described. The film supply roller 7 is arranged above the plane 23 on which the original enters, and the film supply roller 6 is arranged below this plane. The film webs, which are pulled obliquely from the film supply rollers 6 and 7, are brought together, in a V-shape prior to entering the exposing station 5.

In order to ensure that the leading edge of original 22 is kept in alignment while the original is being guided, and to ensure that the original is reproduced in a satisfactory manner, the composite body formed by the film webs 9*a* and 9*b* and the original 22 must be tightly compressed during the transport operation and must be held under tension. This is effected by an arrangement whereby the film supply rollers 6 and 7 are prestressed by means of internal springs (not shown) against the direction in which the film webs 9*a* and 9*b* are pulled off. The film webs 9*a* and 9*b* are not fully wound onto the rollers 6 and 7.

The original 22 to be copied, carrying an image on one side, is inserted into the pocket 48 which is formed by the film webs. The script on the original image is positioned facing toward the photoconductor surface 30, that is to say, the script faces the film web 9*b*, and the original 22 is inserted until its leading edge is positioned closely against the joint seam 9*d* in FIG. 5*a*. The film web 9*b* runs from the upper film supply roller 7 into the exposing station 5, via a deflecting roller 27 and the pressure roller 28. The lower film web 9*a*, from the lower film supply roller 6, is guided by the pressure roller 28 to converge with the upper film web 9*b*. The two film webs 9*a* and 9*b*, with the original 22 which has been inserted, are guided through the exposing station 5 as an extended multi-ply sheet. This multi-ply sheet is in contact with a partial region of the photoconductor surface 30, and the reproduction of the original 22 is effected by transmitted light onto this partial region of the photoconductor surface 30. After leaving the region of contact, this multi-ply sheet is guided over and around a further auxiliary roller 29, and is deflected toward the take-up roller 8. The combined webs 9 are wound onto the take-up roller 8. The diameter of the take-up roller 8 exceeds that of a film supply roller by a factor of approximately 3 to 5, the two film supply rollers 6 and 7 generally having identical diameters. The take-up roller 8 generally rotates at a constant angular velocity and at the same speed as the photoconductor surface 30, or at the same peripheral speed as the drum 1. The take-up roller 8 is preferably designed with a diameter such that a plurality of layers are not formed during the operation of winding on the multi-ply sheet composed of the film webs 9*a* and 9*b* with the original 22 present between them onto the roller. If the multi-ply sheet produces more than one layer on the roller, this would increase the diameter of the take-up roller 8 to such an extent that, at a constant angular velocity, the traction speed of the original 22 would exceed the speed of the drum 1 or of the photoconductor surface 30, and would, in fact, result in the shortening of the copy compared to the original 22. If designing the take-up roller in this manner would lead to an unsuitably large drum diameter, the diameter of the take-up roller 8 must be designed to be at least sufficiently large to ensure that any reduction in the length of the copy, compared to the original, remains within certain tolerance limits. Another but more expensive method involves the reduction, by suitable electromechnical measures, of the angular velocity of the take-up roller 8 in accordance with the growth of its diameter.

Figure 1:
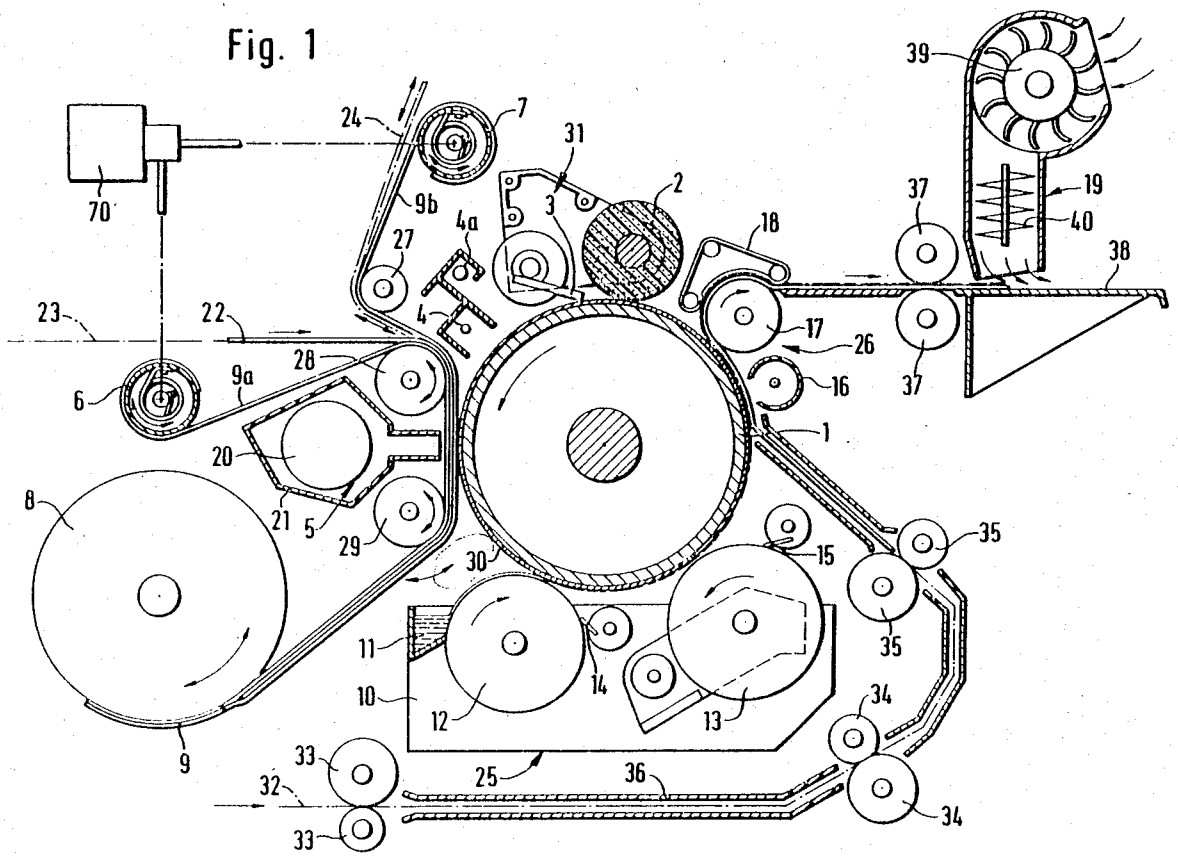
FIG. 1 shows, in a diagrammatic sectional representation, a first embodiment of an electrophotographic copier for the contact exposure of originals, according to the present invention.

As can be seen from FIG. 1, the take-up roller 8 and the two film supply rollers 6 and 7 are arranged on the same side of the drum 1, and the take-up roller 8 is located beneath the lower film supply roller 6. As soon as the original 22 has completely passed through the exposing station 5, after the copying operation, the common drive system 70 for the film supply rollers 6 and 7 reverses the direction of rotation of these rollers to the direction opposite to that in which the original 22 is transported. This drive system 70 can be a gear mechanism or an intermeshing toothed wheel belt which is connected to the shaft of a motor for driving the transport elements of the electrophotographic copier.

The exposing station 5 essentially comprises an elongated exposing lamp 20 which is enclosed by a housing 21 and extends, transversely, across the width of the drum 1. The housing 21 is shaped to form a narrow exposing slit facing toward the photoconductor surface 30. The electrostatically charged photoconductor surface 30 is exposed by rays from this slit which pass through the original 22, which is running in synchronism with the surface 30 in a manner reproducing the image, and is thus discharged. The exposing lamp 20 is preferably of the fluorescent type.

The two auxiliary rollers 28 and 29 can be pivoted or moved toward the photoconductor surface 30 or the drum 1 by means of, for example, levers (not shown) so that the multi-ply sheet, composed of the film webs 9*a* and 9*b*, with the original 22 lying between them, either contacts the drum 1 with a defined pressure, or can be guided past the drum 1, without contact, a short distance away. The latter position is necessary when the original 22 is being repetition copied, following the production of an image on the photoconductor surface 30, so that the original 22 can be guided back, past the photoconductor surface 30, into the starting position, without contact occurring.

The latent charge image which is obtained after an image of the original 22 has been formed on the photoconductor surface 30 is developed in the developing station 25 by a conventional method. This developing station 25 comprises a developer drain trough 10 in which an applicator roller 12 for developer and a stripping roller 13 are installed. The stripping roller 13 is installed behind the applicator roller 12 in the direction of rotation of the drum 1. The developer applicator roller 12 rotates clockwise, while the stripping roller 13 rotates counterclockwise. The developer liquid is applied to the developer applicator roller 12 via a developer application channel 11. The developer is cleaned from both the applicator roller 12 and the stripping roller 13 by means of scrapers 14 and 15 respectively which bear, with pressure, against the peripheral surfaces of these rollers. The charge image which is developed by the liquid developer in the developing station 25 is transferred in the transfer station 26 to an image receiving material, for example to a sheet of paper. The image receiving material is fed to a feed device 32, is acquired by a pair 33 of draw-in rollers, and is conveyed, onward, in a guide path 36. Pairs 34 and 35 of transport rollers are installed along this guide path 36 for the onward conveyance of the image receiving material which, at the exit from the guide path 36, lands obliquely on the photoconductor surface 30.

The transfer station 26 contains a transfer corona 16. This corona generates an electrostatic field which brings about the transfer of the liquid developed, latent charge image, from the photoconductor surface 30, onto the image receiving material. In addition, the transfer station contains a reversing roller 17, which separates the image receiving material from the photoconductor surface 30 and conveys it toward a copy outlet 38. For separating the image receiving material from the photoconductor surface 30, the reversing roller 17 interacts with a continuously revolving reversing belt 18, which is guided over three rollers, not marked more specifically, and a portion of which bears against the periphery of the reversing roller 17. A pair 37 of pull-off rollers ensures that the image receiving material is smoothly discharged onto the copy outlet 38 above which a fixing station 19 is arranged. By means of an intake fan 39, this fixing station draws in air, which is heated by a heating device 40 and is directed onto the surface of the copy in order to fix the toner image.

The cleaning station 31 comprises a cleaning roller 2 and a cleaning wiper blade 3 arranged behind the cleaning roller. The cleaning station 31 is positioned after the transfer station 26, and, when required, can be swung away from the surface of the drum 1, or from the photoconductor surface 30.

An exit device 24 for originals is located on the same side as the plane 23 on which the originals are drawn in. The exit device 24 runs toward the upper film supply roller 7. As soon as the reproduction or exposure, respectively, of the original 22 has been completed in the exposing station 5, the transporting direction of the film supply rollers 6 and 7 is reversed, by the drive system 70, so that the multi-ply sheet, composed of the film webs **9*a* and 9*b* with the original 22 lying between them, is separated by reverse winding the film webs onto their film supply rollers. In the course of this operation, the original 22, after passing the deflecting roller 27, reaches the exit device 24 for originals via a stripping device which is not shown. If a plurality of copies are to be produced from an original 22, the multi-ply sheet, composed of the film webs and the original, is transported back only by a distance such that the original 22 is not discharged via the exit device 24 after each pass in the repetitive mode. As soon as this position is reached, the film supply rollers 6 and 7 are once again reversed into the transporting direction so that the original 22 executes a new pass through the exposing station 5**, and thus enables another copy to be produced.

For completeness, it should also be noted that, following the cleaning of the photoconductor surface 30 by the cleaning station 31, the residual charge which is still present on the photoconductor surface 30 is removed by means of the discharging corona, or by the discharging lamp **4*a***.

It is useful to apply a direct voltage, of 80 to 120 volts, both to the applicator roller 12 and to the stripping roller 13 in the developing station 25.

Figure 2:
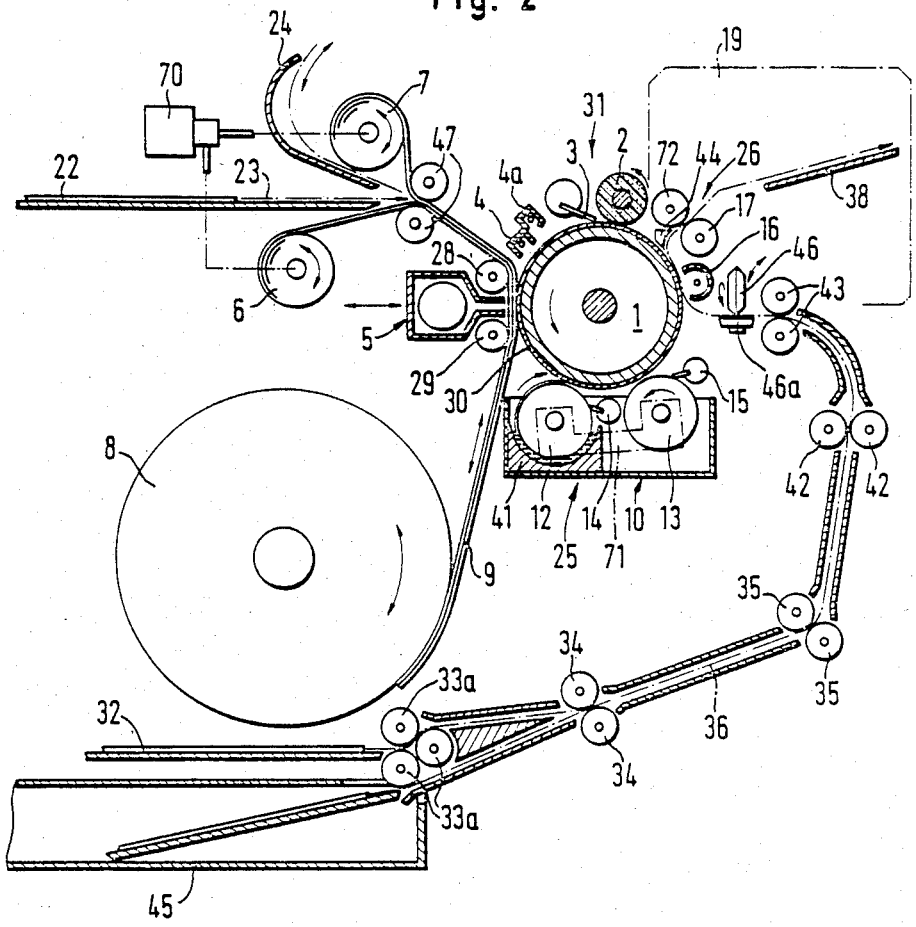
FIG. 2 shows, in a diagrammatic sectional representation, a second embodiment of an electrophotographic copier according to the present invention.
Figure 3:
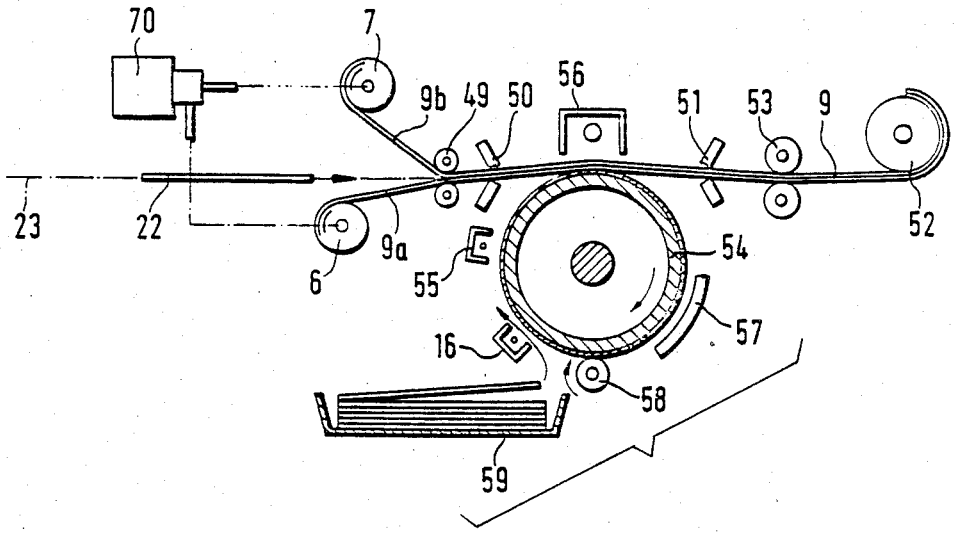
FIG. 3 shows a diagrammatic representation of a third embodiment of an electrophotographic copier for the contact exposure of originals, according to the present invention.

In the illustrative embodiments shown in FIGS. 2, 3, **4*a* and 4*b*, components which match FIG. 1 are marked with the same reference numbers as in FIG. 1**.

In the illustrative embodiment according to FIG. 2, the charging device 4, the exposing station 5, the developing station 25, the transfer station 26, the cleaning station 31, and a discharging lamp **4*a* are likewise arranged along the periphery of the drum 1. Insertion of the original 22 is effected via the horizontal plane 23 on which the originals are drawn in. The apparatus for transporting the original 22 comprises the upper and lower film supply rollers, 6 and 7 respectively, which are driven by the common drive system 70, and further comprises the take-up roller 8, the pressure rollers 28 and 29, which delimit the beginning and the end of the exposing zone, and the film webs 9*a* and 9*b*, the configuration of which has been described by reference to FIGS. 5*a* and 5*b*. The film webs, which are pulled obliquely from the film supply rollers 6 and 7, are drawn together in a V-shape prior to entering the exposing station 5, and are acquired by a pair 47 of draw-in rollers which transport the combined film webs 9 toward the exposing station 5. The arrangement and the modes of operation of the film supply rollers 6 and 7, of the take-up roller 8, of the exposing station 5, and of the pressure rollers 28 and 29, are identical to those in the case of the illustrative embodiment according to FIG. 1**.

The feed device 32 for the image receiving material is located beneath the take-up roller 8, as is a cassette 45 which is filled with the image receiving materials. The image receiving material is supplied either via the feed device 32, or from the cassette 45. In either case, the image receiving material is acquired by two of the total of three draw-in rollers **33*a*, which are installed near the rear edge of the feed device 32 and above the cassette 45. The image receiving material is conveyed along the guide path 36 into the transfer station 26 by means of the pairs 34, 35, 42 and 43** of transport rollers.

The construction of the exposing station 5 is similar to that of the illustrative embodiment according to FIG. 1 and will, for this reason, not be described again.

The latent charge image, which is obtained following the production of an image of the original 22 on the photoconductor surface 30, is developed in the developing station 25 by a conventional method. This developing station 25 comprises a developer drain trough 10 in which a developer applicator trough 41 is located. The curved cross section of this trough 41 partially encloses the developer applicator roller 12 with a clearance. The developer applicator roller 12 rotates clockwise, while the drum 1 rotates counterclockwise. The stripping roller 13 is located outside the developer applicator trough 41, but inside the developer drain trough 10. Developer is cleaned from the applicator roller 12 and from the stripping roller 13 by means of scrapers 14 and 15 respectively, which bear, with pressure, against the peripheral surfaces of these rollers.

The developer applicator roller 12 and the stripping roller 13, which rotates counter to the former roller 12, are mounted in a manner permitting rotation on a common rocker 71. Rocker 71 is capable of pivoting about a fulcrum in a manner such that a small gap is maintained between the developer applicator roller 12 and the photoconductor surface 30, while the stripping roller 13 touches the photoconductor surface 30.

In the transfer station 26, the charge image which has been developed by the liquid developer in the developing station 25 is transferred onto the image receiving material, which is preferably a sheet of paper. The guide path 36 for the image receiving material runs through a device which imparts a slight bend to the material This device is composed of a roll-over surface **46*a* and a bending roller 46 and is arranged between the transport rollers 43 and the transfer station 26. The bending roller 46 travels along on the upper surface of the image receiving material, from one side to the other, as soon as the image receiving material is guided over the roll-over surface 46*a*. This operation produces a slight bend in the image receiving material which can, as a result, be fed into the transfer station 26 without difficulty. Transfer station 26 contains a transfer corona 16, a reversing roller 17 against which a further roller 72 bears, and a lift-off device 44 which detaches the image receiving material from the photoconductor surface 30 and guides it into the gap between the two rollers 17, 72. Thereafter, the image receiving material arrives on the exit device 38 which, in contrast to the horizontal exit device in FIG. 1, is pointed obliquely upward. The fixing station is not represented, being constructed in the same manner as in FIG. 1**.

The cleaning station 31 is composed of the cleaning roller 2 and the cleaning wiper blade 3, which is located behind the roller 2. It is possible to swing the cleaning station 31 away from the surface of the drum 1, or clear of the photoconductor surface 30.

The discharging lamp 4*a* removes the residual charge which is still present on the photoconductor surface 30 and is located after the cleaning station 31. The exit device 24 is located on the same side as the plane 23 on which the originals are drawn in, and runs obliquely upward, near the upper film supply roller 7.

A schematic representation of a further embodiment of the invention is shown in FIG. 3. In this embodiment, the plane 23 on which the originals are drawn in and the point at which the multi-ply sheet emerges, are located on opposite sides of a photoconductor drum 54. The original 22 is introduced along the plane 23 into the space between the film webs 9*a* and 9*b*, which converge in a V-arrangement. On being drawn into an exposing station 56, the film webs 9*a* and 9*b* are held together with the original 22 by means of two draw-in rollers 49 which are made of a soft, resilient material, for example of rubber. The extended multi-ply sheet, composed of the film webs and the original, is then brought into contact with the photoconductor drum 54. The exposing station 56 is positioned above the contact surface. Station 56 is of similar construction to the exposing station 5 in the illustrative embodiments according to FIGS. 1 and 2. The photoconductive surface of the photoconductor drum 54 is surface charged by means of a charging corona 55. The charged photoconductive layer is discharged in a manner corresponding to the image produced by the original by means of the incident light from the exposing station 56, which extends transversely over the width of the photoconductor drum 54 and possesses a narrow exposing slit. The latent charge image is then rendered visible in a developing station 57, which is indicated diagrammatically, by means of a known method employing a liquid developer. Excess dispersing liquid, belonging to the liquid developer, is removed by means of a stripping roller 58 which operates in the opposite direction to the rotation of the photoconductor drum 54.

The image receiving material, for example copying paper, is fed to the transfer station from a stock container 59. The image is transferred in this transfer station from the photoconductive surface of the photoconductor drum 54 onto the image receiving material, with the aid of the transfer corona 16.

In order to ensure that the film webs and the original run in synchronism with the photoconductor drum 54, synchronizing rollers 53 are provided and are driven at the same peripheral speed as the photoconductor drum 54.

A take-up roller 52 is equipped with a slip clutch, and winds up the extended multi-ply sheet which is offered to it. As soon as the original has passed through the exposing region, the film supply rollers 6 and 7, which are preloaded in the forward direction, are frictionally connected to the drive system 70, in the reverse direction. At the same time, the synchronizing rollers 53 and the take-up roller 52 are decoupled from the drive. On the other hand, the photoconductor drum 54 continues to run.

In order to prevent the lower film web 9*a* from trailing on the photoconductive surface of the photoconductor drum 54, it is expedient to raise the film web 9*a* just sufficiently to ensure that it no longer touches the photoconductor drum.

The contact between the photoconductor drum 54 and the lower film web 9*a* causes this web to be moistened with dispersing liquid. In order to keep this web clean, wiper blades 50 bear against the upper and lower surfaces of the combined film webs in advance of the exposing station 56, and wiper blades 51 bear against the upper and lower surfaces of the combined webs at a point following the exposing station 56. The lower wiper blades keep the film web 9*a* clean, in both directions of movement. The upper wiper blades, which bear against the upper surface of the upper film web 9*b*, serve to wipe away dust which is attracted by electrostatic charge. In addition, it is expedient that these wiper blades be conductive, in order to be capable of conducting the electrostatic charge away to ground.

In the case of an embodiment which is modified with respect to FIG. 3, the drive rollers 53, which run in synchronism with the photoconductor drum, can be omitted and the take-up roller 52 can instead be driven directly at the same peripheral speed as the photoconductor drum 54.

When operating in the repetitive mode, the original 22 is guided in reverse by the film webs 9*a* and 9*b* just to the point where these webs still hold the original 22. During reversing, a dead time results which is proportional to the length of the original 22. In order to keep this time short, the reversing speed can be designed to be higher than the forward running speed. In doing so, attention should be paid to the fact that running speeds in excess of 20 m/min can be achieved only with difficulty, since after the film webs have been separated and wound onto their respective film supply rollers 6 and 7, the original is no longer guided, but is fluttering without support. Planar guide devices, similar to the plane 23 on which the originals are drawn in, admittedly enable this effect to be suppressed, but cannot eliminate it completely.

Figure 4A:
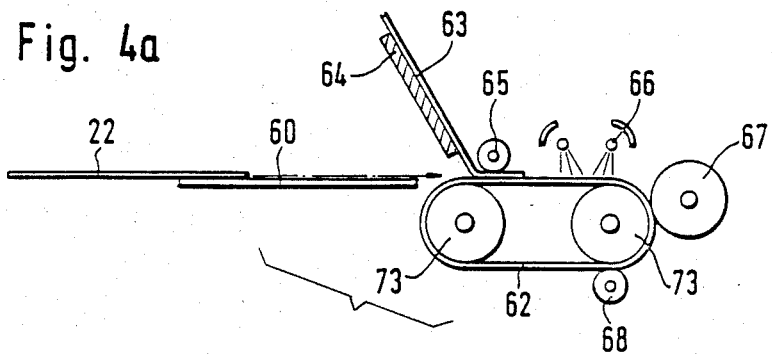
FIGS. 4*a* and 4*b* show a transport device with the film webs in two different operating positions of a further embodiment of an electrophotographic copier for the reflex exposure of originals according to the present invention.
Figure 4B:
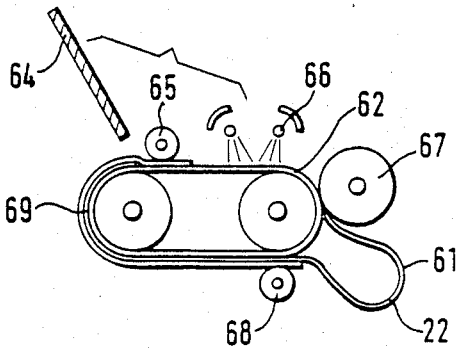

Two operating stages of a modified embodiment of the invention are diagrammatically represented in FIGS. 4*a* and 4*b*. This embodiment permits the achievement of short dead times between the individual copies when operating in the repetitive mode. Moreover, these dead times are made independent of the length of the original to be copied. This embodiment is suitable for reflex exposure of the original by arranging the photoconductor drum (not shown) above an exposing station 66.

The original 22 which is to be copied is guided, with the image facing upward, over a draw-in plate 60 into a gap which is formed between a revolving, opaque, endless film web 62, and a clear, transparent film web 63. Film web 62 is composed of, for example, 200 μm thick polyvinyl chloride; and web 63, which is likewise composed of polyvinyl chloride, has a thickness of approximately 100 μm, and is flush-welded onto the film web 62. The film web 63 rests against a guide element 64 without being attached to it. This guide element 64 runs at an angle to the horizontal. The endless film web 62 and the film web 63, with the original 22 between them, are pressed together by means of a pressure roller 65, and held under tension. The length of the film web 63 corresponds to the shortest format of the original 22 to be copied. The length of the film web 63 can, for example, be approximately 30 cm. The length of the endless film web 62 exceeds that of the film web 63 by the distance between the pressure roller 65 and a further pressure roller 68. The multi-ply sheet 69, composed of the endless film web 62 and the film web 63 with the original 22 located between them, is guided through the exposing station 66, which comprise, for example, two exposing sources and associated reflectors. The exposing sources and reflectors are arranged at a distance from one another and thus leave an unobstructed opening through which the rays of light, reflected by the image of the original 22, can pass. As already mentioned, the Figure represents neither the photoconductor drum, nor the optical system for imaging the reflected light rays onto the surface of the photoconductor drum in a sharply focused manner. Instead of a photoconductor drum, it is also possible, of course, to provide an endlessly revolving photoconductive recording material. When a photoconductor drum is used, its design corresponds approximately to that of the photoconductor drums as represented in FIGS. 1 to 3.

As explained with reference to FIG. 4*b*, the endless film web 62 ceases to revolve as soon as the rear edge of the film web 63 reaches the pressure roller 68. Even after the endless film web 62 has stopped, a pressure roller 67, which bears against one of the two rollers 73 over which rollers the multi-ply sheet 69 is guided, continues to run at a constant peripheral speed and transports the original 22 in a manner such that it forms a loop 61. As soon as the end of the original 22 has reached the pressure roller 67, the endless film web 62 and the pressure rollers 65, 68 restart, thus enabling the next copy to be produced. Once the last copy of a copying cycle has been produced, the direction in which all the transport elements are driven is reversed, so that the original 22 re-emerges from the entry slot.

As soon as the free edge of the transparent film web 63 has passed the pressure roller 65, the web 63 is guided upward by means of a switching device (not shown) so that it again rests against the guide element 64.

The foregoing illustrative embodiments are set forth for the purpose of describing the present invention and are not meant to limit it in any way. Clearly, numerous modifications can be made by one of ordinary skill in the art without departing from the scope of the invention as set forth in the appended claims.

What is claimed is:

1. An electrophotographic copier, comprising:

an exposing station having an entry zone with an entry plane on which an original to be copied is introduced into said entry zone; and transport means for repetitively transporting an original through said exposing station from said entry zone, said transport means comprising: two film webs bonded at a joint seam to form a Y-shaped pocket for receiving a leading edge of an original to be copied, said Y-shaped pocket being positioned in said entry zone to receive an original to be copied from said entry plane; and means for closing said Y-shaped pocket on an original and drawing said film webs past said exposing station from said entry zone.

2. The electrophotographic copier as set forth in claim 1, wherein said joint seam extends transversely across the direction of movement of said film webs when they are drawn past said exposing station.

3. The electrophotographic copier as set forth in claim 1, including two film supply rollers, a portion of each of said film webs being wound onto a different one of said film supply rollers.

4. The electrophotographic copier as set forth in claim 3, wherein one of said film supply rollers is positioned above said entry plane and the other film supply roller is arranged below said entry plane, and further wherein said means for closing said Y-shaped pocket includes means for directing film webbing from said film supply rollers into a V shape in said entry zone.

5. The electrophotographic copier as set forth in claim 4, and further including means for prestressing said film supply rollers against the direction in which said film webs are drawn off.

6. The electrophotographic copier as set forth in claim 3, further including a take-up roller positioned to wind up said film webs after passing through said exposing station.

7. The electrophotographic copier as set forth in claim 6, wherein said take-up roller has a diameter greater than the diameter of either of said film supply rollers.

8. The electrophotographic copier as set forth in claim 7, including a photoconductor surface, means for moving said photoconductor surface through said exposing station, and means for rotating said take-up roller at a constant angular velocity and at a peripheral speed equal to that of said photoconductor surface.

9. The electrophotographic copier as set forth in claim 7, wherein said take-up roller diameter is 3 to 5 times greater than said supply roller diameters.

10. The electrophotographic copier as set forth in claim 8, including a drum, said photoconductor surface being attached to a surface of said drum, said two film supply rollers and said take-up roller being positioned on the same side of said drum and said take-up roller being positioned below one of said film supply rollers.

11. The electrophotographic copier as set forth in claim 3, including a common drive system for said film supply rollers including means for reversing the direction of rotation of said film supply rollers after an original to be copied has passed through said exposing station.

12. The electrophotographic copier as set forth in claim 3, including a drum and a photoconductor surface on said drum, and means for moving said photoconductor surface through said exposing station, and further including an exit device positioned on the same side of said drum as said entry plane, said exit device including means for removing an original from said film webs towards one of said film supply rollers.

13. The electrophotographic copier as set forth in claim 8, including a drum, said photoconductor surface being attached to a surface of said drum and wherein said film supply rollers are arranged on one side of said drum and said take-up roller is arranged on an opposite side of said drum.

14. The electrophotographic copier as set forth in claim 6, wherein a pair of drive rollers are positioned between said exposing station and said take-up roller with said film webs being disposed between said drive rollers, and including means for rotating said drive rollers at a peripheral speed which is synchronous with the speed of said photoconductor surface.

15. The electrophotographic copier as set forth in claim 3, including a drum and a photoconductor surface on said drum, and means for moving said photoconductor surface through said exposing station, and further including an exit device positioned on the opposite side of said drum from said entry plane, said exit device including means for removing an original from said film webs.

16. The electrophotographic copier as set forth in claim 1, including a first pair of upper blades positioned on one side of said exposing station to bear against said film webs, and a second set of wiper blades positioned on an opposite side of said exposing station to bear against said film webs.

17. The electrophotographic copier as set forth in claim 1, wherein one of said film webs is an endless belt and the other of said film webs is a tongue fastened to said endless belt and having a length at least equal to the length of the smallest original to be copied.

* * * * *